US011840763B2

(12) United States Patent
Liu et al.

(10) Patent No.: US 11,840,763 B2
(45) Date of Patent: Dec. 12, 2023

(54) METAL-COATED STEEL STRIP

(71) Applicant: Bluescope Steel Limited, Melbourne (AU)

(72) Inventors: Qiyang Liu, Mount Keira (AU); Wayne Renshaw, Unanderra (AU); Joe Williams, Woonona (AU)

(73) Assignee: Bluescope Steel Limited, Melbourne (AU)

( * ) Notice: Subject to any disclaimer, the term of this patent is extended or adjusted under 35 U.S.C. 154(b) by 0 days.

(21) Appl. No.: 17/829,764

(22) Filed: Jun. 1, 2022

(65) Prior Publication Data

US 2022/0364215 A1 Nov. 17, 2022

Related U.S. Application Data

(63) Continuation of application No. 17/173,507, filed on Feb. 11, 2021, now abandoned, which is a continuation of application No. 15/848,546, filed on Dec. 20, 2017, now abandoned, which is a continuation of application No. 12/811,213, filed as (Continued)

(30) Foreign Application Priority Data

Mar. 13, 2008 (AU) ..... 2008901223
Mar. 13, 2008 (AU) ..... 2008901224

(51) Int. Cl.

| | |
|---|---|
| ***C23C 2/06*** | (2006.01) |
| ***C23C 2/14*** | (2006.01) |
| ***C23C 2/28*** | (2006.01) |

(52) U.S. Cl.

CPC ..... *C23C 2/06* (2013.01); *C23C 2/14* (2013.01); *C23C 2/29* (2022.08); *Y10T 428/12757* (2015.01); *Y10T 428/12972* (2015.01); *Y10T 428/12979* (2015.01)

(58) Field of Classification Search

None

See application file for complete search history.

(56) References Cited

U.S. PATENT DOCUMENTS

| | | | |
|---|---|---|---|
| 3,343,930 | A | 9/1967 | Borzillo et al. |
| 3,782,909 | A | 1/1974 | Cleary et al. |
| 4,401,727 | A | 8/1983 | Berke et al. |

(Continued)

FOREIGN PATENT DOCUMENTS

| | | |
|---|---|---|
| EP | 28821 | 5/1981 |
| EP | 545049 A1 | 6/1993 |

(Continued)

OTHER PUBLICATIONS

PCT International Preliminary Report on Patentability, PCT/AU2009/000305, dated Sep. 14, 2010, (5 pages).

(Continued)

*Primary Examiner* — Daniel J. Schleis

(74) *Attorney, Agent, or Firm* — STERNE, KESSLER, GOLDSTEIN & FOX P.L.L.C.

(57) ABSTRACT

An Al—Zn—Si—Mg alloy coated strip that has $Mg_2Si$ particles in the coating microstructure is disclosed. The distribution of $Mg_2Si$ particles is such that the surface of the coating has only a small proportion of $Mg_2Si$ particles or is at least substantially free of any $Mg_2Si$ particles.

8 Claims, 1 Drawing Sheet

Related U.S. Application Data application No. PCT/AU2009/000305 on Mar. 13, 2009, now abandoned.

(56) References Cited

U.S. PATENT DOCUMENTS

| | | | | |
|---|---|---|---|---|
| 4,412,870 | A | 11/1983 | Vernam et al. | |
| 5,141,781 | A | 8/1992 | Suzuki et al. | |
| 5,360,641 | A * | 11/1994 | Tu | B05C 11/06 427/430.1 |
| 5,571,327 | A | 11/1996 | Ookouchi et al. | |
| 6,610,422 | B1 | 8/2003 | Ooi et al. | |
| 6,635,359 | B1 * | 10/2003 | Kurosaki | C23C 2/12 428/653 |
| 6,689,489 | B2 | 2/2004 | McDevitt | |
| 8,293,376 | B2 | 10/2012 | Liu et al. | |
| 2003/0152796 | A1 | 8/2003 | Clancy et al. | |
| 2006/0057417 | A1 | 3/2006 | Tada et al. | |
| 2006/0177687 | A1 | 8/2006 | Renshaw et al. | |

FOREIGN PATENT DOCUMENTS

| | | | |
|---|---|---|---|
| EP | 1199376 | | 4/2002 |
| EP | 1489195 | | 12/2004 |
| EP | 1557478 | | 7/2005 |
| EP | 3757245 | A1 | 12/2020 |
| GB | 2243843 | A | 11/1991 |
| JP | S5956570 | A | 4/1984 |
| JP | 1279767 | | 10/1989 |
| JP | 6020228 | | 3/1993 |
| JP | H06279889 | | 10/1994 |
| JP | H10152765 | | 6/1998 |
| JP | H11343599 | A | 12/1999 |
| JP | 2000104153 | A | 4/2000 |
| JP | 2000328214 | | 11/2000 |
| JP | 2001089838 | | 4/2001 |
| JP | 2001115247 | | 4/2001 |
| JP | 2001316791 | | 11/2001 |
| JP | 2001323357 | | 11/2001 |
| JP | 2001355055 | | 12/2001 |
| JP | 2002012959 | | 1/2002 |
| JP | 2002322527 | | 8/2002 |
| JP | 2002129300 | | 9/2002 |
| JP | 2002285310 | | 10/2002 |
| JP | 2002332555 | | 11/2002 |
| JP | 2002348649 | A | 12/2002 |
| JP | 2002363722 | A | 12/2002 |
| JP | 2002371344 | | 12/2002 |
| JP | 2003277906 | | 10/2003 |
| JP | 2003328506 | | 11/2003 |
| JP | 2004238682 | | 8/2004 |
| JP | 2005015907 | | 1/2005 |
| JP | 2005133151 | A | 5/2005 |
| JP | 2005036304 | | 10/2005 |
| JP | 2006022409 | | 1/2006 |
| JP | 2007284718 | | 11/2007 |
| JP | 2011514935 | | 5/2011 |
| KR | 20040058492 | | 7/2007 |
| WO | 2001011100 | | 2/2001 |
| WO | 2001027343 | | 4/2001 |
| WO | 2004083480 | | 9/2004 |
| WO | 2006070995 | A1 | 7/2006 |
| WO | 2006105593 | | 10/2006 |
| WO | 2007133440 | A1 | 11/2007 |
| WO | 2008025066 | | 3/2008 |
| WO | 2008141398 | | 11/2008 |
| WO | 2009111843 | | 9/2009 |
| WO | 2010102343 | A1 | 9/2010 |

OTHER PUBLICATIONS

PCT/AU2009/000305 International Search Report dated May 5, 2009 (3 pages).

Brazil Patent Office Technical Examination Report for related Application No. PI0907447-3 dated Oct. 2, 2018 (7 pages).

China Patent Office Action for related Application No. 200980101691.9 dated Jul. 20, 2011 (7 pages including English Translation).

Europe Patent Office Extended Search Report for related Application No. 09719076.3 dated Feb. 8, 2011 (9 pages).

English Translation of Japanese Patent Office Action Summary for related Application No. 2010-549998 dated Feb. 12, 2014 (2 pages).

English Translation of Korean Patent Office Reasons for Rejection for related Application No. 10-2010-7014576 dated Jun. 20, 2014 (6 pages).

New Zealand Patent Office Examination Report for related Application No. 586488 dated Mar. 8, 2013 (2 pages).

Cleary, The Microstructure and corrosion Resistance of 55% Al—Zn Coatings on Sheet Steel, Microstructural Science, 12, 1985, 103.

Liu et al., "Influence of alloyed magnesium on the microstructure and long term corrosion behavior of hot-dip Al—Zn—Si coating in NaCl solution," Corrosion Science, 2016, 104(2016): 217-226.

Marder, "Effects of Surface Treatments on Materials Performance", Materials Selection and Design, ASM Handbook, ASM, vol. 20, 1997, 470-490.

Marder, "Introduction to Transformation Microstructures", ASM Handbook: Metallography and Microstructure, vol. 9, 2004, 132-133.

Marder, Microstructural Characterization of Zinc Coatings in Zinc-based Steel Coating Systems: Metallurgy and Performance, TMS, 1990, 55-82.

Nolan "The Effects of Alloying Additions on the Microstructure and Corrosion Properties of an Al—Zn galvanizing alloy" Master of Engineering Thesis, 1993, 272 pages.

Nolan et al., "The effects of magnesium additions on the microstructure of Zn-55%Al-1.6%Si Galvanizing alloys and coatings," Proc. Of Microscopy: Materials and Techniques, Sydney, Sep. 1993, Publ. by the Institute of Metals and Materials Australasia, pp. 85-90.

Sabs, "Properties of a 55% Aluminium-Zinc Coating on Steel Sheeting," <http://www.safalgroup.com/SABS-AZ-fact-sheet.pdf> 2016.

Selverian et al., "The Effect of silicon on the Reaction Between Solid Iron and Liquid 55 Wt PCT Al—Zn Baths," Met Trans A, 20A, 1989, 543-555.

Selverian et al., "The Microstructure of 55 w/o AlZN-Si (Galvalume) Hot Dip Coatings," J. Materials Engineering, 9, 1987, 133-140.

The ASM Handbook, "Corrosion: Fundamentals, Testing, and Protection," vol. 13A, pp. 126-146.

The ASM Handbook, "Surface Engineering," vol. 5, 1994, pp. 99-125.

Townsend et al., "Atmospheric Corrosion Resistance of 55% Al—Zn-Coated Sheet Steel: Thirteen-Year Test Results," Materials Performance, 18 (10), 13-20, Oct. 1979.

Townsend et al., "Performance of Al—Zn Alloy Coated Steel Sheet After Twenty-Two Years of Atmospheric Corrosion Testing," in Proceedings of the Second International Conference on Zinc-Coated Sheet, J. Edwards, Ed., Zinc Development Association, London, 1989, pp. 69-79.

Townsend et al., "Thirty-Year Atmospheric Corrosion Performance of 55% Aluminium-Zinc Alloy-Coated Sheet Steel," Galvatech '95 Proceedings, Iron and Steel Society, Warrendale, PA (1995) 171-177; also in Materials Performance, 35 (4), 30-36 (1996).

Townsend et al., "Twenty-Year Atmospheric Corrosion Tests of Hot-Dip Coated Sheet Steel," Materials Performance, 26 (7), 37-41 (1987).

Townsend, "Aluminium-Zinc Alloy-Coated Steel," Encyclopedia of Materials Science and Engineering, 1986, pp. 175-180.

Townsend, "Twenty-Five-Year Corrosion Tests of 55% Al—Zn Alloy Coated Steel Sheet," Materials Performance, 32 (4), 68-71 (1993).

Selverian et al., "The Reaction Between Solid Iron and Liquid Al—Zn Baths," Met Trans A, 1988, vol. 19A, pp. 1193-1203.

Australian Standard, Methods for the Determination of Grain Size in Metals, AS 1733-1976, p. 1-5, 1976.

ASTM International, "Standard Specification for Steel Sheet, 55% Aluminum-Zinc Alloy-Coated by the Hot-Dip Process", 2009, 7 pages.

(56) References Cited

OTHER PUBLICATIONS

Hosking et al., "Corrosion resistance of zinc-magnesium coated steel", Corrosion Science, 2007, vol. 49, pp. 3669-3695.
European Patent Office Notice of Opposition for Application No. 09719076.3 dated Oct. 8, 2021 (27 pages).
Japanese Patent Office Notice of Reasons for Rejection for Application No. 2021-033593 dated Mar. 15, 2022 (16 pages including English translation).

* cited by examiner

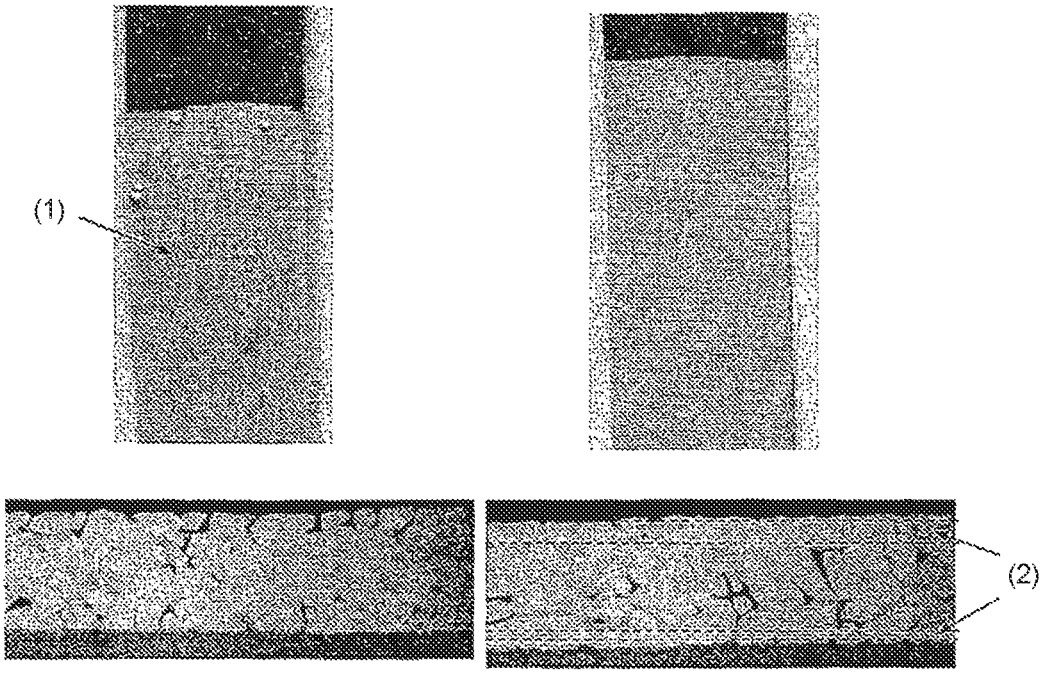
Strontium-free
Strontium addition

METAL-COATED STEEL STRIP

The present invention relates to strip, typically steel strip, which has a corrosion-resistant metal alloy coating.

The present invention relates particularly to a corrosion-resistant metal alloy coating that contains aluminium-zinc-silicon-magnesium as the main elements in the alloy, and is hereinafter referred to as an "Al—Zn—Si—Mg alloy" on this basis. The alloy coating may contain other elements that are present as deliberate alloying additions or as unavoidable impurities. Hence, the phrase "Al—Zn—Si—Mg alloy" is understood to cover alloys that contain such other elements and the other elements may be deliberate alloying additions or as unavoidable impurities.

The present invention relates particularly but not exclusively to steel strip that is coated with the above-described Al—Zn—Si—Mg alloy and can be cold formed (e.g. by roll forming) into an end-use product, such as roofing products.

Typically, the Al—Zn—Si—Mg alloy comprises the following ranges in % by weight of the elements aluminium, zinc, silicon, and magnesium:

Aluminium: 40 to 60%

Zinc: 40 to 60%

Silicon: 0.3 to 3%

Magnesium 0.3 to 10%

Typically, the corrosion-resistant metal alloy coating is formed on steel strip by a hot dip coating method.

In the conventional hot-dip metal coating method, steel strip generally passes through one or more heat treatment furnaces and thereafter into and through a bath of molten metal alloy held in a coating pot. The heat treatment furnace that is adjacent a coating pot has an outlet snout that extends downwardly to a location below the upper surface of the bath.

The metal alloy is usually maintained molten in the coating pot by the use of heating inductors. The strip usually exits the heat treatment furnaces via an outlet end section in the form of an elongated furnace exit chute or snout that dips into the bath. Within the bath the strip passes around one or more sink rolls and is taken upwardly out of the bath and is coated with the metal alloy as it passes through the bath.

After leaving the coating bath the metal alloy coated strip passes through a coating thickness control station, such as a gas knife or gas wiping station, at which its coated surfaces are subjected to jets of wiping gas to control the thickness of the coating.

The metal alloy coated strip then passes through a cooling section and is subjected to forced cooling.

The cooled metal alloy coated strip may thereafter be optionally conditioned by passing the coated strip successively through a skin pass rolling section (also known as a temper rolling section) and a tension levelling section. The conditioned strip is coiled at a coiling station.

A 55% Al—Zn alloy coating is a well known metal alloy coating for steel strip. After solidification, a 55% Al—Zn alloy coating normally consists of $\alpha$-Al dendrites and a $\beta$-Zn phase in the inter-dendritic regions of the coating.

It is known to add silicon to the coating alloy composition to prevent excessive alloying between the steel substrate and the molten coating in the hot-dip coating method. A portion of the silicon takes part in a quaternary alloy layer formation but the majority of the silicon precipitates as needle-like, pure silicon particles during solidification. These needle-like silicon particles are also present in the inter-dendritic regions of the coating.

It has been found by the applicant that when Mg is included in a 55% Al—Zn—Si alloy coating composition, Mg brings about certain beneficial effects on product performance, such as improved cut-edge protection, by changing the nature of corrosion products formed.

However, it has also been found by the applicant that Mg reacts with Si to form a $Mg_2Si$ phase and that the formation of the $Mg_2Si$ phase compromises the above-mentioned beneficial effects of Mg in a number of ways.

One particular way, which is the focus of the present invention is a surface defect called "mottling". The applicant has found that mottling can occur in Al—Zn—Si—Mg alloy coatings under certain solidification conditions. Mottling is related to the presence of the $Mg_2Si$ phase on the coating surface.

More particularly, mottling is a defect where a large number of coarse $Mg_2Si$ particles cluster together on the surface of the coating, resulting in a blotchy surface appearance that is not acceptable from an aesthetic viewpoint. More particularly, the clustered $Mg_2Si$ particles form darker regions approximately 1-5 mm in size and introduce non-uniformity in the appearance of the coating which makes the coated product unsuitable for applications where a uniform appearance is important.

The above description is not to be taken as an admission of the common general knowledge in Australia or elsewhere.

The present invention is an Al—Zn—Si—Mg alloy coated strip that has $Mg_2Si$ particles in the coating microstructure with the distribution of $Mg_2Si$ particles being such that the surface of the coating has only a small proportion of $Mg_2Si$ particles or is at least substantially free of any $Mg_2Si$ particles.

The applicant has found that the above-described distribution of $Mg_2Si$ particles in the coating microstructure provides significant advantages and can be achieved by any one or more of:

(a) strontium additions in the coating alloy, (b) selection of the cooling rate during solidification of coated strip for a given coating mass (i.e. coating thickness) exiting a coating bath; and (c) minimising variations in coating thickness.

The applicant has found that Sr additions described in more detail below control the distribution characteristics of the $Mg_2Si$ phase in the thickness direction of an Al—Zn—Si—Mg alloy coating so that the surface of the coating has only a small proportion of $Mg_2Si$ particles or is at least substantially free of $Mg_2Si$ particles, whereby there is a considerably lower risk of $Mg_2Si$ mottling.

In particular, the applicant has found that when at least 250 ppm Sr, preferably 250-3000 ppm Sr, is added to a coating bath containing an Al—Zn—Si—Mg alloy the distribution characteristics of the $Mg_2Si$ phase in the coating thickness direction are completely changed by this addition of Sr from the distribution that is present when there is no Sr in the coating bath. Specifically, the applicant has found that these additions of Sr promote the formation of a surface of the coating that has only a small proportion of $Mg_2Si$ particles or is free of any $Mg_2Si$ particles and consequently a considerably lower risk of mottling on the surface.

The applicant has also found that selecting the cooling rate during solidification of a coated strip exiting a coating bath to be below a threshold cooling rate, typically below 80° C./sec for coating masses less than 100 grams per square metre of strip surface per side, controls the distribution characteristics of the $Mg_2Si$ phase so that the surface has only a small proportion of $Mg_2Si$ particles or is at least substantially free of $Mg_2Si$ particles, whereby there is a considerably lower risk of $Mg_2Si$ mottling.

The applicant has also found that minimising coating thickness variations controls the distribution characteristics of the $Mg_2Si$ phase so that the surface has only a small proportion of $Mg_2Si$ particles or is at least substantially free of $Mg_2Si$ particles, whereby there is a considerably lower risk of $Mg_2Si$ mottling. As is the case with Sr addition and selection of cooling rate during solidification, the resultant coating microstructure is advantageous in terms of appearance, enhanced corrosion resistance and improved coating ductility.

According to the present invention there is provided an Al—Zn—Si—Mg alloy coated steel strip that comprises a coating of an Al—Zn—Si—Mg alloy on a steel strip, with the microstructure of the coating comprising $Mg_2Si$ particles, and with the distribution of the $Mg_2Si$ particles being such that there is only a small proportion of $Mg_2Si$ particles or at least substantially no $Mg_2Si$ particles in the surface of the coating.

The small proportion of $Mg_2Si$ particles in the surface region of the coating may be no more than 10 wt. % of the $Mg_2Si$ particles.

Typically, the Al—Zn—Si—Mg alloy comprises the following ranges in % by weight of the elements aluminium, zinc, silicon, and magnesium:

Aluminium: 40 to 60%

Zinc: 40 to 60%

Silicon: 0.3 to 3%

Magnesium 0.3 to 10%

The Al—Zn—Si—Mg alloy may also contain other elements, such as, by way of example any one or more of iron, vanadium, chromium, and strontium.

Typically, the coating thickness is less than 30 μm.

Preferably the coating thickness is greater than 7 μm.

Preferably the coating contains more than 250 ppm Sr, with the Sr addition promoting the formation of the above distribution of $Mg_2Si$ particles in the coating.

Preferably the coating contains more than 500 ppm Sr.

Preferably the coating contains more than 1000 ppm Sr.

Preferably the coating contains less than 3000 ppm Sr.

The Al—Zn—Si—Mg—Sr alloy coating may contain other elements as deliberate additions or as unavoidable impurities.

Preferably there are minimal coating thickness variations.

According to the present invention there is also provided a hot-dip coating method for forming a coating of a corrosion-resistant Al—Zn—Si—Mg alloy on a steel strip that is characterised by passing the steel strip through a hot dip coating bath that contains Al, Zn, Si, Mg, and more than 250 ppm Sr and optionally other elements and forming an alloy coating on the strip that has $Mg_2Si$ particles in the coating microstructure with the distribution of the $Mg_2Si$ particles being such that there is only a small proportion of $Mg_2Si$ particles or substantially no $Mg_2Si$ particles in the surface of the coating.

The small proportion of $Mg_2Si$ particles in the surface region of the coating may be no more than 10 wt. % of the $Mg_2Si$ particles.

Preferably the coating contains more than 500 ppm Sr.

Preferably the coating contains at least 1000 ppm Sr.

Preferably the molten bath contains less than 3000 ppm Sr.

The Al—Zn—Si—Mg—Sr alloy coating may contain other elements as deliberate additions or as unavoidable impurities.

According to the present invention there is also provided a hot-dip coating method for forming a coating of a corrosion-resistant Al—Zn—Si—Mg alloy on a steel strip that is characterised by passing the steel strip through a hot dip coating bath that contains Al, Zn, Si, and Mg and optionally other elements and forming an alloy coating on the strip, and cooling coated strip exiting the coating bath during solidification of the coating at a rate that is controlled so that the distribution of $Mg_2Si$ particles in the coating microstructure is such that there is only a small proportion of $Mg_2Si$ particles or substantially no $Mg_2Si$ particles in the surface of the coating.

The small proportion of $Mg_2Si$ particles in the surface region of the coating may be no more than 10 wt. % of the $Mg_2Si$ particles.

Preferably the method comprises selecting the cooling rate for coated strip exiting the coating bath to be less than a threshold cooling rate.

In any given situation, the selection of the required cooling rate is related to the coating thickness (or coating mass).

Preferably the method comprises selecting the cooling rate for coated strip exiting the coating bath to be less than 80° C./sec for coating masses up to 75 grams per square metre of strip surface per side.

Preferably the method comprises selecting the cooling rate for coated strip exiting the coating bath to be less than 50° C./sec for coating masses of 75-100 grams per square metre of strip surface per side.

Typically, the method comprises selecting the cooling rate to be at least 11° C./sec.

By way of example, for a coating having an average thickness of 22 μm, during solidification preferably the cooling rates are as follows:

(a) 55° C./sec in a temperature range of 600-530° C., (b) 70° C./sec in a temperature range of 530-500° C., and (c) 80° C./sec in a temperature range of 500-300° C.

The coating bath and the coating on steel strip coated in the bath may contain Sr.

According to the present invention there is also provided a hot-dip coating method for forming a coating of a corrosion-resistant Al—Zn—Si—Mg alloy on a steel strip that is characterised by passing the steel strip through a hot dip coating bath that contains Al, Zn, Si, and Mg and optionally other elements and forming an alloy coating on the strip with minimal variation in the thickness of the coating so that the distribution of $Mg_2Si$ particles in the coating microstructure is such that there is only a small proportion of $Mg_2Si$ particles or substantially no $Mg_2Si$ particles in the surface of the coating.

The small proportion of $Mg_2Si$ particles in the surface region of the coating may be no more than 10 wt. % of the $Mg_2Si$ particles.

Preferably the coating thickness variation should be no more than 40% in any given 5 mm diameter section of the coating.

More preferably the coating thickness variation should be no more than 30% in any given 5 mm diameter section of the coating.

In any given situation, the selection of an appropriate thickness variation is related to the coating thickness (or coating mass).

By way of example, for a coating thickness of 22 μm, preferably the maximum thickness in any region of the coating greater than 1 mm in diameter should be 27 μm.

Preferably the method comprises selecting the cooling rate during solidification of coated strip exiting the coating bath to be less than a threshold cooling rate.

The coating bath and the coating on steel strip coated in the bath may contain Sr.

The hot-dip coating method may be the conventional method described above or any other suitable method.

The advantages of the invention include the following advantages.

Elimination of mottling defect and improved first-time-prime production rate. The risk of the mottling defect is at least substantially eliminated and the surface of the resultant coating maintains a beautiful, silvery metallic appearance. As a result, first-time-prime production rate is improved and profitability is boosted.

Prevention of mottling defect by the addition of Sr allows the use of higher cooling rates, reducing the length of cooling equipment required after the pot.

EXAMPLE

The applicant has carried out laboratory experiments on a series of 55% Al—Zn-1.5% Si-2.0% Mg alloy compositions having up to 3000 ppm Sr coated on steel substrates.

The purpose of these experiments was to investigate the impact of Sr on mottling in the surface of the coatings.

FIG. 1 summarises the results of one set of experiments carried out by the applicant that illustrate the present invention. In particular, FIG. 1 shows Sr additions in a 55% Al—Zn-1.5% Si-2.0% Mg coating eliminate the surface mottling defect and change the distribution pattern of the $Mg_2Si$ phase in the coating thickness direction The left hand side of the FIGURE comprises a top plan view of a coated steel substrate and a cross-section through the coating with the coating comprising a 55% Al—Zn-1.5% Si-2.0% Mg alloy with no Sr. The coating was not formed having regard to the selection of cooling rate during solidification and coating thickness variations discussed above.

The mottling that results from such a coating composition is identified by the arrow (1) in the top plan view. It is evident from the cross-section that $Mg_2Si$ particles are distributed throughout the coating thickness. This is a problem for the reasons stated above.

The right hand side of the FIGURE comprises a top plan view of a coated steel substrate and a cross-section through the coating, with the coating comprising a 55% Al—Zn-1.5% Si-2.0% Mg alloy and 500 ppm Sr. A complete absence of mottling is evident from the top plan view. In addition, the cross-section illustrates upper and lower regions at the coating surface and at the interface with the steel substrate that are completely free of $Mg_2Si$ particles, as identified by the arrows (2), with the $Mg_2Si$ particles being confined to a central band of the coating. This is advantageous for the reasons stated above.

The photomicrographs of the FIGURE illustrate clearly the benefits of the addition of Sr to an Al—Zn—Si—Mg coating alloy.

The laboratory experiments found that the microstructure shown in the right hand side of the FIGURE were formed with Sr additions in the range of 250-3000 ppm.

The applicant has also carried out line trials on 55% Al—Zn-1.5% Si-2.0% Mg alloy composition (not containing Sr) coated on steel substrates.

The purpose of these trials was to investigate the impact of cooling rates and coating masses on mottling in the surface of the coatings.

The trials covered a range of coating masses from 60 to 100 grams per square metre surface per side of strip, with cooling rates up to 90° C./sec.

The applicant found two factors that affected the coating microstructure, particularly the distribution of $Mg_2Si$ particles in the coatings, in the trials.

The first factor is the effect of the cooling rate of the strip exiting the coating bath before completing the coating solidification. The applicant found that controlling the cooling rate makes it possible to avoid mottling.

By way of example, the applicant found that for a AZ150 class coating (or 75 grams of coating per square metre surface per side of strip—refer to Australia Standard AS1397-2001), if the cooling rate is greater than 80° C./sec, $Mg_2Si$ particles formed on the surface of the coating. In particular, when the cooling rate was greater than 100° C./sec, mottling occurred.

The applicant also found that for the same coating it is not desirable that the cooling rate be too low, particularly below 11° C./sec, as in this case the coating develops a defective "bamboo" structure, whereby the zinc-rich phases forms a vertically straight corrosion path from the coating surface to the steel interface, which compromises the corrosion performance of the coating.

Therefore, for a AZ150 class coating, under the experimental conditions tested, the cooling rate should be controlled to be in a range of 11-80° C./sec to avoid mottling on the surface.

On the other hand, the applicant also found that for a AZ200 class coating, if the cooling rate was greater than 50° C./sec, $Mg_2Si$ particles formed on the surface of the coating and mottling occurred.

Therefore, for a AZ200 class coating, under the experimental conditions tested, a cooling rate in a range of 11-50° C./sec is desirable.

The second important factor found by the applicant is the uniformness of coating thickness across the strip surface.

The applicant found that the coating on the strip surface normally had thickness variations that are (a) long range (across the entire strip width, measured by the "weight-strip-weight" method on a 50 mm diameter disc) and (b) short range (across every 25 mm length in the strip width direction, measured in the cross-section of the coating under a microscope with 500× magnification). In a production situation, the long range thickness variation is normally regulated to meet the minimum coating mass requirements as defined in relevant national standards. In a production situation, as far is the applicant is aware, there is no regulation for short range thickness variation, as long as the minimum coating mass requirements as defined in relevant national standards are met.

However, the applicant found that short range coating thickness variations could be very high, and special operational measures had to be applied to keep the variations under control. It was not uncommon in the experimental work for the coating thickness to change by a factor of two or more over a distance as short as 5 mm, even when the product perfectly met the minimum coating mass requirements as defined in relevant national standards. This short range coating thickness variation had a pronounced impact on the $Mg_2Si$ particles in the surface of coatings.

By way of example, the applicant found that for a AZ150 class coating even in the desirable cooling rate ranges as described above, if the short range coating thickness variation was greater than 40% above the nominal coating thickness within a distance of 5 mm across the strip surface, $Mg_2Si$ particles formed on the surface of the coating and thereby increased the risk of mottling.

Therefore, under the experimental conditions tested, the short range coating thickness variation should be controlled to no greater than 40% above the nominal coating thickness within a distance of 5 mm across the strip surface to avoid mottling.

The research work carried out by the applicant on the solidification of Al—Zn—Si—Mg coatings, which is extensive and is described in part above, has helped the applicant to develop an understanding of the formation of the $Mg_2Si$ phase in a coating and the factors affecting its distribution in the coating. Whilst the applicant does not wish to be bound by the following discussion, this understanding is as set out below.

When an Al—Zn—Si—Mg alloy coating is cooled to a temperature in the vicinity of 560° C., the α-Al phase is the first phase to nucleate. The α-Al phase then grows into a dendritic form. As the α-Al phase grows, Mg and Si, along with other solute elements, are rejected into the molten liquid phase and thus the remaining molten liquid in the interdendritic regions is enriched in Mg and Si.

When the enrichment of Mg and Si in the interdendritic regions reaches a certain level, the $Mg_2Si$ phase starts to form, which also corresponds to a temperature around 465° C. For simplification, it will be assumed that an interdendritic region near the outer surface of the coating is region A and another interdendritic region near the quaternary intermetallic alloy layer at the steel strip surface is region B. It will also be assumed that the level of enrichment in Mg and Si is the same in region A as in region B.

At or below 465° C., the $Mg_2Si$ phase has the same tendency to nucleate in region A as in region B. However, the principles of physical metallurgy teach us that a new phase will preferably nucleate at a site whereupon the resultant system free energy is the minimum. The $Mg_2Si$ phase would normally nucleate preferably on the quaternary intermetallic alloy layer in region B provided the coating bath does not contain Sr (the role of Sr with Sr-containing coatings is discussed below). The applicant believes that this is in accordance with the principles stated above, in that there is a certain similarity in crystal lattice structure between the quaternary intermetallic alloy phase and the $Mg_2Si$ phase, which favours the nucleation of $Mg_2Si$ phase by minimizing any increase in system free energy. In comparison, for the $Mg_2Si$ phase to nucleate on the surface oxide of the coating in region A, the increase in system free energy would have been greater.

Upon nucleation in region B, the $Mg_2Si$ phase grows upwardly, along the molten liquid channels in the interdendritic regions, towards region A. At the growth front of the $Mg_2Si$ phase (region C), the molten liquid phase becomes depleted in Mg and Si (depending on the partition coefficients of Mg and Si between the liquid phase and the $Mg_2Si$ phase), compared with that in region A. Thus a diffusion couple forms between region A and region C. In other words, Mg and Si in the molten liquid phase will diffuse from region A to region C. Note that the growth of the α-Al phase in region A means that region A is always enriched in Mg and Si and the tendency for the $Mg_2Si$ phase to nucleate in region A always exists because the liquid phase is "undercooled" with regard to the $Mg_2Si$ phase.

Whether the $Mg_2Si$ phase is to nucleate in region A, or Mg and Si are to keep diffusing from region A to region C, will depend on the level of Mg and Si enrichment in region A, relevant to the local temperature, which in turn depends on the balance between the amount of Mg and Si being rejected into that region by the α-Al growth and the amount of Mg and Si being moved away from that region by the diffusion. The time available for the diffusion is also limited, as the $Mg_2Si$ nucleation/growth process has to be completed at a temperature around 380° C., before the L→Al—Zn eutectic reaction takes place, wherein L depicts the molten liquid phase.

The applicant has found that controlling the balance between the time available for diffusion and the diffusion distance for Mg and Si can control the subsequent nucleation or growth of the $Mg_2Si$ phase or the final distribution of the $Mg_2Si$ phase in the coating thickness direction.

In particular, the applicant has found that for a set coating thickness, the cooling rate should be regulated to a particular range, and more particularly not to exceed a threshold temperature, to avoid the risk for the $Mg_2Si$ phase to nucleate in region A. This is because for a set coating thickness (or a relatively constant diffusion distance between regions A and C), a higher cooling rate will drive the α-Al phase to grow faster, resulting in more Mg and Si being rejected into the liquid phase in region A and a greater enrichment of Mg and Si, or a higher risk for the $Mg_2Si$ phase to nucleate, in region A (which is undesirable).

On the other hand, for a set cooling rate, a thicker coating (or a thicker local coating region) will increase the diffusion distance between region A and region C, resulting in a smaller amount of Mg and Si being able to move from region A to region C by the diffusion within a set time and in turn a greater enrichment of Mg and Si, or a higher risk for the $Mg_2Si$ phase to nucleate, in region A (which is undesirable).

Practically, the applicant has found that, to achieve the distribution of $Mg_2Si$ particles of the present invention, i.e. to avoid mottling defect on the surface of a coated strip, the cooling rate for coated strip exiting the coating bath has to be in a range of 11-80° C./sec for coating masses up to 75 grams per square metre of strip surface per side and in a range 11-50° C./sec for coating masses of 75-100 grams per square metre of strip surface per side. The short range coating thickness variation also has to be controlled to be no greater than 40% above the nominal coating thickness within a distance of 5 mm across the strip surface to achieve the distribution of $Mg_2Si$ particles of the present invention.

The applicant has also found that, when Sr is present in a coating bath, the above described kinetics of $Mg_2Si$ nucleation can be significantly influenced. At certain Sr concentration levels, Sr strongly segregates into the quaternary alloy layer (i.e. changes the chemistry of the quaternary alloy phase). Sr also changes the characteristics of surface oxidation of the molten coating, resulting in a thinner surface oxide on the coating surface. Such changes alter significantly the preferential nucleation sites for the $Mg_2Si$ phase and, as a result, the distribution pattern of the $Mg_2Si$ phase in the coating thickness direction. In particular, the applicant has found that, Sr at concentrations 250-3000 ppm in the coating bath makes it virtually impossible for the Mg2Si phase to nucleate on the quaternary alloy layer or on the surface oxide, presumably due to the very high level of increase in system free energy would otherwise be generated. Instead, the $Mg_2Si$ phase can only nucleate at the central region of the coating in the thickness direction, resulting in a coating structure that is substantially free of $Mg_2Si$ at both the coating outer surface region and the region near the steel surface. Therefore, Sr additions in the range 250-3000 ppm are proposed as one of the effective means to achieve a desired distribution of $Mg_2Si$ particles in a coating.

Many modifications may be made to the present invention as described above without departing from the spirit and scope of the invention.

In this context, whilst the above description of the present invention focuses on (a) the addition of Sr to Al—Zn—Si—Mg coating alloys, (b) cooling rates (for a given coating mass) and (c) control of short range coating thickness variation as means for achieving a desired distribution of $Mg_2Si$ particles in coatings, i.e. at least substantially no $Mg_2Si$ particles in the surface of a coating, the present invention is not so limited and extends to the use of any suitable means to achieve the desired distribution of $Mg_2Si$ particles in the coating.

The invention claimed is:

1. A hot-dip coating method to reduce mottling defect on a surface of a coating of a coated steel strip, the method comprising:

passing a steel strip through a hot dip coating bath that contains aluminum, zinc, silicon, and magnesium to form an alloy coating on the steel strip having, in weight %, 40 to 60% aluminum; 40 to 60% zinc; 0.3 to 3% silicon; and 0.3 to 10% magnesium to produce the coated steel strip, and controlling a coating thickness and a short range coating thickness variation of the coating of the coated steel strip, including:

passing the coated steel strip through a coating thickness control station to control the coating thickness to be greater than 7 μm and less than 30 μm from the steel strip and to control the short range coating thickness variation to be no more than 40% in a 5 mm diameter section of the coating, and cooling the coated steel strip, wherein the coating has a microstructure comprising $Mg_2Si$ particles, and wherein controlling the coating thickness and the short range coating thickness variation controls the distribution characteristics of $Mg_2Si$ phase such that the surface of the coating has no more than 10 wt % of $Mg_2Si$ particles to reduce mottling defect on the surface of the coating.

2. The method defined in claim 1 wherein the coating thickness variation is no more than 30% in a 5 mm diameter section of the coating.

3. The method defined in claim 1 wherein, for a coating thickness of 22 μm, the maximum thickness in a region of the coating greater than 1 mm in diameter is 27 μm.

4. The method defined in claim 1 wherein the hot dip coating bath comprises one or more of strontium, iron, vanadium and chromium and the coating comprises one or more of strontium, iron, vanadium and chromium.

5. The method defined in claim 1 wherein the surface of the coating has no $Mg_2Si$ particles.

6. The method defined in claim 1 wherein the surface of the coating is substantially free of $Mg_2Si$ particles.

7. The method defined in claim 1 wherein the coating thickness control station is a gas knife or gas wiping station.

8. The method defined in claim 1 wherein cooling the coated steel strip occurs at a cooling rate of less than 80° C./sec and greater than 11° C./sec for coating masses up to 75 grams per square meter of strip surface per side, or at a cooling rate of less than 50° C./sec and greater than 11° C./sec for coating masses of 75-100 grams per square meter of strip surface per side.

* * * * *